US010046933B2

(12) United States Patent
Ohashi et al.

(10) Patent No.: US 10,046,933 B2
(45) Date of Patent: Aug. 14, 2018

(54) IMAGE FORMING APPARATUS

(71) Applicant: Konica Minolta, Inc., Chiyoda-ku, Tokyo (JP)

(72) Inventors: Masakatsu Ohashi, Aichi (JP); Naoki Watanabe, Kanagawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/855,441

(22) Filed: Sep. 16, 2015

(65) Prior Publication Data

US 2016/0077480 A1 Mar. 17, 2016

(30) Foreign Application Priority Data

Sep. 16, 2014 (JP) ..... 2014-187779

(51) Int. Cl.

| | |
|---|---|
| ***B65H 9/00*** | (2006.01) |
| ***B65H 5/06*** | (2006.01) |
| ***B65H 7/02*** | (2006.01) |
| ***G03G 15/00*** | (2006.01) |

(52) U.S. Cl.

CPC ..... *B65H 9/002* (2013.01); *B65H 5/068* (2013.01); *B65H 7/02* (2013.01); *G03G 15/657* (2013.01); *G03G 15/6573* (2013.01); *B65H 2404/144* (2013.01)

(58) Field of Classification Search

CPC .. B65H 2404/14212; B65H 2404/1423; B65H 2404/1441; B65H 5/068; B65H 2404/144

See application file for complete search history.

(56) References Cited

U.S. PATENT DOCUMENTS

| | | | | |
|---|---|---|---|---|
| 4,844,438 A * | 7/1989 | Mistyurik | B65C 9/10 | 271/181 |
| 5,110,104 A * | 5/1992 | Wakao | G03G 15/234 | 271/176 |
| 7,458,577 B2 * | 12/2008 | Terada | B41J 11/06 | 271/272 |
| 2008/0138188 A1 * | 6/2008 | Pillard | B65H 29/18 | 414/798.2 |

FOREIGN PATENT DOCUMENTS

| | | | |
|---|---|---|---|
| JP | 2002-316748 A | | 10/2002 |
| JP | 2008162785 A | * | 7/2008 |
| JP | 2011-102157 A | | 5/2011 |
| JP | 2013133179 A | * | 7/2013 |

* cited by examiner

*Primary Examiner* — Howard J Sanders

(74) *Attorney, Agent, or Firm* — Buchanan Ingersoll & Rooney PC

(57) ABSTRACT

An image forming apparatus includes: an image forming section configured to form an image on a sheet; conveyance guides disposed on an image forming surface side and a rear surface side of the sheet at a position on a downstream side of the image forming section in a sheet conveyance direction, and configured to form a sheet feeding path for conveying the sheet; a conveyance rolling part disposed to protrude from the conveyance guide into the sheet feeding path at a curving part of the sheet feeding path; and a rolling member moving section configured to move the conveyance rolling part along the sheet feeding path until a state where an image forming surface of a sheet being conveyed does not make contact with the conveyance guide is ensured.

11 Claims, 11 Drawing Sheets

IMAGE FORMING APPARATUS

CROSS REFERENCE TO RELATED APPLICATIONS

This application is entitled to and claims the benefit of Japanese Patent Application No. 2014-187779, filed on Sep. 16, 2014, the disclosure of which including the specification, drawings and abstract is incorporated herein by reference in its entirety.

BACKGROUND OF THE INVENTION

1. Field of the Invention

The present invention relates to an electrophotographic image forming apparatus.

2. Description of Related Art

In general, an electrophotographic image forming apparatus (such as a printer, a copy machine, and a fax machine) is configured to irradiate (expose) a uniformly-charged photoconductor (for example, a photoconductor drum) with (to) laser light based on image data to form an electrostatic latent image on the surface of the photoconductor. The electrostatic latent image is then visualized by supplying toner from a developing device to the photoconductor on which the electrostatic latent image is formed, whereby a toner image is formed. Further, the toner image is directly or indirectly transferred to a sheet through an intermediate transfer belt, followed by heating and pressurization for fixing at a fixing section, whereby an image is formed on the sheet.

Such an image forming apparatus has conveyance guides that respectively face the front and rear surfaces of a sheet. A sheet feeding path is formed by the conveyance guides, and a sheet is conveyed along the sheet feeding path. In addition, for the purpose of downsizing the apparatus and adopting duplex image formation, the sheet feeding path is curved to a certain extent. At a curving part having a large curvature, and a part where the curvature changes in the sheet feeding path, a conveyance rolling part having a small frictional coefficient and protruding from the conveyance guide toward the inside of the sheet feeding path is disposed (see, for example, Japanese Patent Application Laid-Open Nos. 2002-316748 and 2011-102157). The conveyance rolling part is a rotating member that makes contact with a conveyed sheet and rotates along the sheet, and examples of the conveyance rolling part include a conveyance rolling part having one wide rolling member extending in the sheet width direction, and a conveyance rolling part having a plurality of narrow rolling members juxtaposed along the sheet width direction.

In recent years, demand for high image quality is strong, and only a small damage on the image forming surface, which has caused no problem in the past, may cause problems, especially in the field of production printers used for commercial printing such as on-demand printing. Meanwhile, the types of sheets used in commercial printing have been diversified to include sheets (coated sheets, for example) whose image forming surface is easily damaged. In the case where a coated sheet is used, the image forming surface of the sheet can be damaged by just making contact with the guide member, and such damage easily stands out.

As illustrated in FIGS. 1A and 1B, in a conventional image forming apparatus, a plurality of conveyance rolling parts 32 to 34 are disposed on the image forming surface side of the sheet at curving part 165R of sheet feeding path 165. A sheet output from conveyance roller section 31 is conveyed in contact with conveyance rolling parts 32 to 34, and therefore the image forming surface of the sheet does not make contact with conveyance guide 35 or 36.

In addition, in view of avoiding corner folding of the sheet, the entering angle of the sheet to the conveyance rolling part is preferably small. For this reason, a conveyance rolling part having a large diameter like conveyance rolling part 33 is often used. At this time, rolling members 321, 331 and 341 of conveyance rolling parts 32 to 34 may overlap each other in the sheet conveyance direction due to a limited installation space. In this case, rolling members 321, 331 and 341 of conveyance rolling parts 32 to 34 are disposed in a staggered manner in the sheet width direction such that conveyance rolling part 32, conveyance rolling part 33 and conveyance rolling part 34 do not interfere each other (see FIG. 1B).

As described above, when a sheet is conveyed with the configuration where rolling members of conveyance rolling parts adjacent to each other are disposed in a staggered manner, an end portion of the sheet in the sheet width direction and an end portion of the rolling member overlap each other, and as a result, sheet conveyance failure may be caused. For example, when rolling members 321, 331 and 341 are disposed such that A5 sheets and A3 sheets can be used with no problem as illustrated in FIG. 2A and FIG. 2B, an end portion of the sheet in the sheet width direction and an end portion of rolling member 331 may overlap each other when A4 sheets are conveyed as illustrated in FIG. 2C.

In view of this, it is preferable to configure the conveyance rolling parts such that end portions of the sheet in the sheet width direction do not overlap with any end portions of the rolling members regardless of the size of the sheet. However, non-uniformity among the components of the image forming apparatus, non-uniformity caused at the time of installation, and non-uniformity in position of the sheets during conveyance in the sheet width direction are unavoidable, and therefore it is difficult to achieve a design in which end portions of the sheet in the sheet width direction and end portions of the rolling members do not overlap each other regardless of the size of the sheet.

SUMMARY OF THE INVENTION

An object of the present invention is to provide an image forming apparatus which can readily convey a sheet in a sheet feeding path having a curved shape without causing failure.

To achieve at least one of the abovementioned objects, an image forming apparatus reflecting one aspect of the present invention includes: an image forming section configured to form an image on a sheet; conveyance guides disposed on an image forming surface side and a rear surface side of the sheet at a position on a downstream side of the image forming section in a sheet conveyance direction, and configured to form a sheet feeding path for conveying the sheet; a conveyance rolling part disposed to protrude from the conveyance guide into the sheet feeding path at a curving part of the sheet feeding path; and a rolling member moving section configured to move the conveyance rolling part along the sheet feeding path until a state where an image forming surface of a sheet being conveyed does not make contact with the conveyance guide is ensured.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1A:
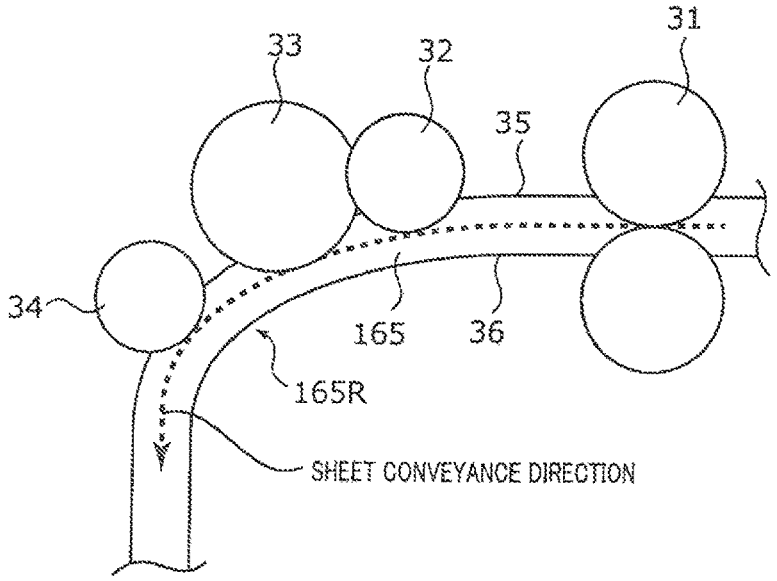
FIG. 1A is a front view illustrating positions of conveyance rolling parts disposed at a curving part of a conveyance guide section as viewed from a sheet width direction.
Figure 1B:
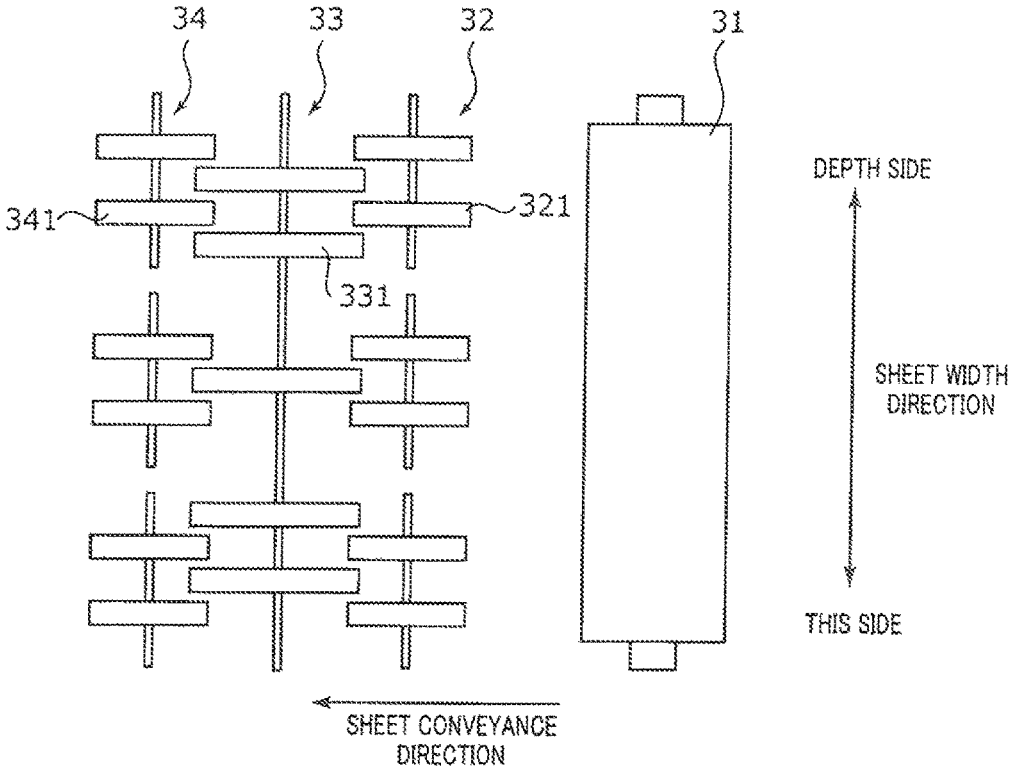
FIG. 1B is a plan view illustrating positions of the conveyance rolling parts as viewed from a sheet thickness direction (upward)
Figure 2A:
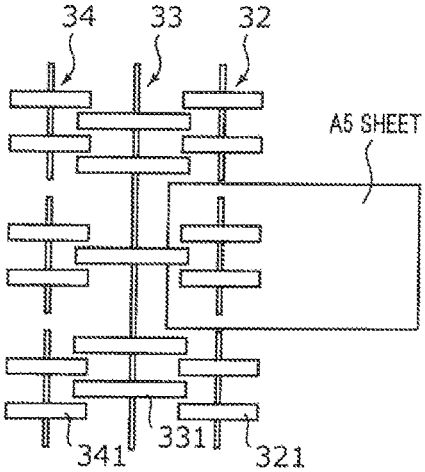
FIG. 2A illustrates an exemplary positional relationship between end portions of a sheet in a sheet width direction and end portions of rolling members at the time of sheet conveyance.
Figure 2B:
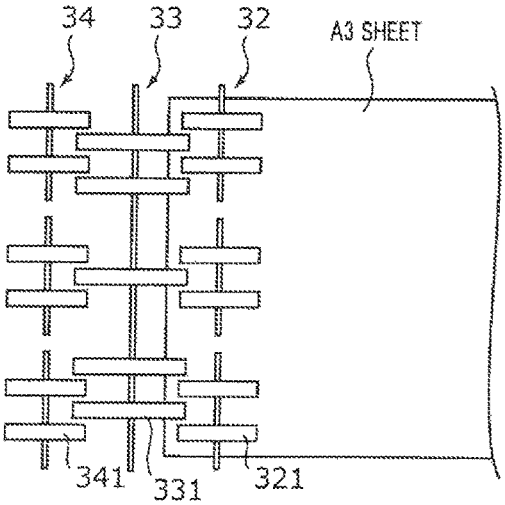
FIG. 2B illustrates another exemplary positional relationship between end portions of a sheet in a sheet width direction and end portions of rolling members at the time of sheet conveyance.
Figure 2C:
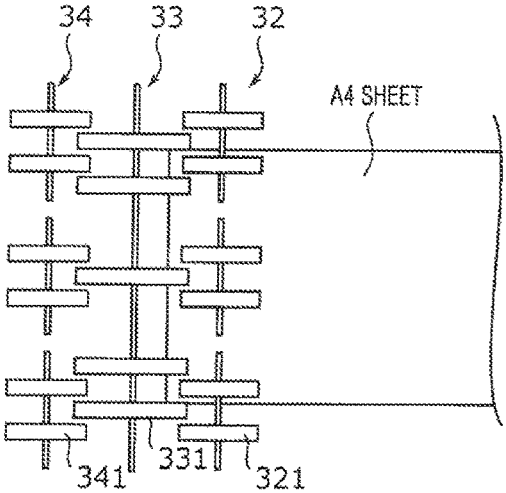
FIG. 2C illustrates another exemplary positional relationship between end portions of a sheet in a sheet width direction and end portions of rolling members at the time of sheet conveyance.

In the following, the embodiment of the present invention is described referring to the drawings.

Figure 3:
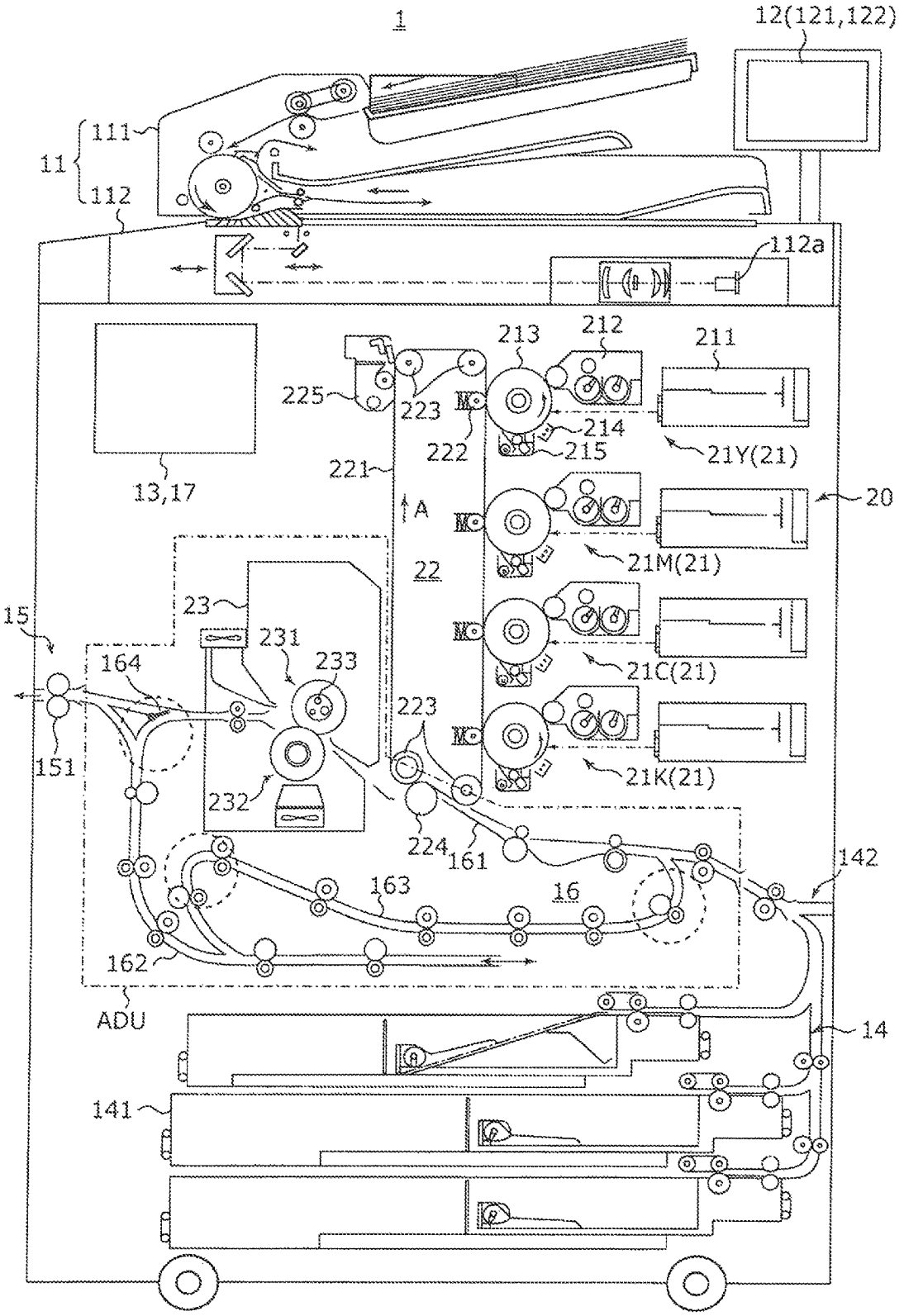
FIG. 3 illustrates a general configuration of an image forming apparatus.
Figure 4:
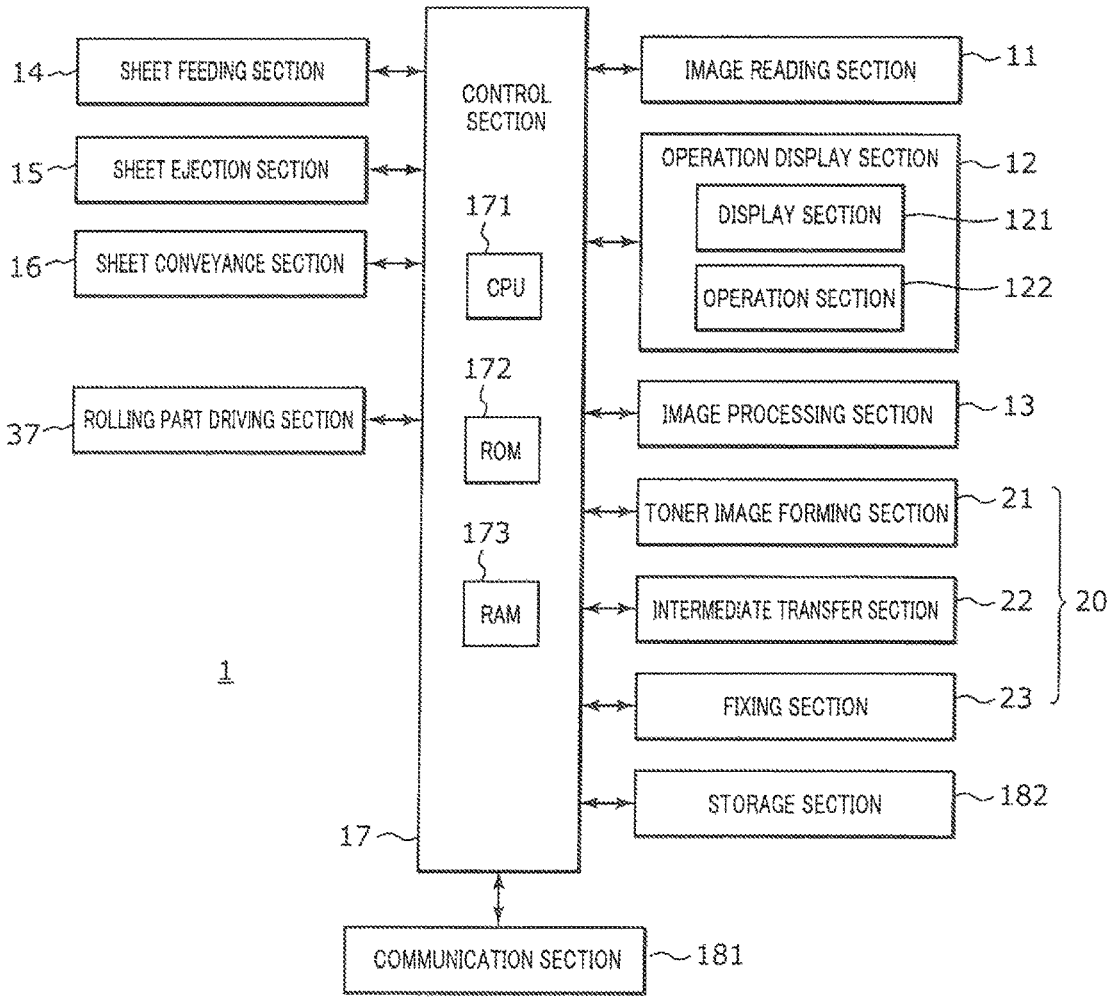
FIG. 4 illustrates a principal part of a control system of the image forming apparatus.

FIG. 3 illustrates a general configuration of image forming apparatus 1. FIG. 4 illustrates a principal part of a control system of image forming apparatus 1.

Image forming apparatus 1 illustrated in FIGS. 3 and 4 is a color image forming apparatus of an intermediate transfer system using electrophotographic process technology. A longitudinal tandem system is adopted for image forming apparatus 1. In the longitudinal tandem system, respective photoconductor drums 213 corresponding to the four colors of YMCK are placed in series in the travelling direction (vertical direction) of intermediate transfer belt 221, and the toner images of the four colors are sequentially transferred to intermediate transfer belt 221 in one cycle.

That is, image forming apparatus 1 transfers (primary-transfers) toner images of yellow (Y), magenta (M), cyan (C), and black (K) formed on photoconductor drums 213 to intermediate transfer belt 221, and superimposes the toner images of the four colors on one another on intermediate transfer belt 221. Then, image forming apparatus 1 secondary-transfers the resultant image to a sheet, thereby forming an image.

As illustrated in FIGS. 3 and 4, image forming apparatus 1 includes image reading section 11, operation display section 12, image processing section 13, image forming section 20, sheet feeding section 14, sheet ejection section 15, sheet conveyance section 16, and control section 17.

Control section 17 includes central processing unit (CPU) 171, read only memory (ROM) 172, random access memory (RAM) 173 and the like. CPU 171 reads a program suited to processing details out of ROM 172 or storage section 182, develops the program in RAM 173, and integrally controls an operation of each block of image forming apparatus 1 in cooperation with the developed program.

Communication section 181 has various interfaces such as network interface card (NIC), modulator-demodulator (MODEM), and universal serial bus (USB), for example. Storage section 182 is composed of, for example, a non-volatile semiconductor memory (so-called flash memory) or a hard disk drive. Storage section 182 stores therein a look-up table which is referenced when the operation of each block is controlled, for example.

Control section 17 transmits and receives various data to and from an external apparatus (for example, a personal computer) connected to a communication network such as a local area network (LAN) or a wide area network (WAN), through communication section 181. Control section 17 receives image data (input image data) of page description language (PDL) that has been sent from an external device, and controls the apparatus to form an image on a sheet on the basis of the data, for example.

Image reading section 11 includes an automatic document feeder 111 called auto document feeder (ADF), document image scanner (scanner) 112, and the like.

Auto document feeder 111 causes a conveyance mechanism to feed documents placed on a document tray, and sends out the documents to document image scanner 112.

Auto document feeder 111 enables images (even both sides thereof) of a large number of documents placed on the document tray to be successively read at once. Document image scanner 112 optically scans a document fed from auto document feeder 111 to its contact glass or a document placed on its contact glass, and images light reflected from the document on the light receiving surface of charge coupled device (CCD) sensor 112*a*, to thereby read the document image. Image reading section 11 generates input image data on the basis of a reading result provided by document image scanner 112. Image processing section 13 performs predetermined image processing on the input image data.

Operation display section 12 includes, for example, a liquid crystal display (LCD) with a touch panel, and functions as display section 121 and operation section 122. Display section 121 displays various operation screens, image conditions, operating statuses of functions, and the like in accordance with display control signals received from control section 17. Operation section 122 includes various operation keys such as numeric keys and a start key, receives various input operations performed by a user, and outputs operation signals to control section 17.

By operating operation display section 12, the user can perform setting relating to the image formation such as document setting, image quality setting, multiplying factor setting, application setting, output setting, single-sided/duplex printing setting, and sheet setting (including the basis weight of the sheet, and presence of gloss). The information thus set is stored in storage section 182 for example.

Image processing section 13 includes a circuit that performs a digital image process suited to initial settings or user settings on the input image data, and the like. For example, image processing section 13 performs tone correction on the basis of tone correction data under the control of control section 17. Image processing section 13 also performs various correction processes such as color correction and shading correction on the input image data. Image forming section 20 is controlled on the basis of the image data that has been subjected to these processes.

Image forming section 20 includes: toner image forming section 21 configured to form toner images of colored toners respectively containing a Y component, an M component, a C component, and a K component on the basis of the input image data; intermediate transfer section 22 configured to transfer a toner image formed by toner image forming sections 21 to a sheet; fixing section 23 configured to fix a transferred toner image to a sheet; and the like.

Toner image forming section 21 includes four toner image forming sections 21Y, 21M, 21C, and 21K for the Y component, the M component, the C component, and the K component, respectively. Since toner image forming sections 21Y, 21M, 21C, and 21K have similar configurations, common elements are denoted by the same reference signs for ease of illustration and description. Only when elements need to be discriminated from one another, Y, M, C, K is added to their reference signs. In FIG. 3, reference signs are given to only the elements of toner image forming section 21Y for the Y component, and reference signs are omitted for the elements of other toner image forming sections 21M, 21C, and 21K.

Toner image forming section 21 includes exposing device 211, developing device 212, photoconductor drum 213, charging device 214, drum cleaning device 215 and the like.

Photoconductor drum 213 is, for example, a negative-charge-type organic photoconductor (OPC) formed by sequentially laminating an under coat layer (UCL), a charge generation layer (CGL), and a charge transport layer (CTL) on the circumferential surface of a conductive cylindrical body (aluminum-elementary tube) made of aluminum. The charge generation layer is made of an organic semiconductor in which a charge generating material (for example, phthalocyanine pigment) is dispersed in a resin binder (for example, polycarbonate), and generates a pair of positive charge and negative charge through light exposure by exposure device 211.

The charge transport layer is made of a layer in which a hole transport material (electron-donating nitrogen compound) is dispersed in a resin binder (for example, polycarbonate resin), and transports the positive charge generated in the charge generation layer to the surface of the charge transport layer.

Charging device 214 is composed of a corona discharging generator such as a scorotron charging device and a corotron charging device, for example. Charging device 214 evenly negatively charges the surface of photoconductor drum 213 by corona discharge.

Exposing device 211 is composed of, for example, an LED print head including an LED array having a plurality of linearly laid out light-emitting diodes (LED), an LPH driving section (driver IC) for driving each LED, and an lens array that brings light radiated from the LED array into an image on photoconductor drum 213, and the like. Each of the LEDs of LED array 1 corresponds to one dot of an image. When the LPH driving section is controlled by control section 17, a predetermined driving current flows through the LED array, and designated LEDs emit light.

Exposure device 211 irradiates photoconductor drum 213 with light corresponding to the image of each color component. The positive charge generated in the charge generation layer of photoconductor drum 213 irradiated with light is transported to the surface of the charge transport layer, whereby the surface charge (negative charge) of photoconductor drum 213 is neutralized. Thus, an electrostatic latent image of each color component is formed on the surface of photoconductor drum 213 by the potential difference from its surroundings.

Developing device 212 stores developers of respective color components (for example, a two-component developer composed of toner and magnetic carrier). Developing device 212 attaches toner of respective color components to the surfaces of photoconductor drums 213, and visualizes the electrostatic latent image to form a toner image. To be more specific, a developing bias voltage is applied to a developer bearing member (developing roller), and an electric field is formed between photoconductor drum 213 and developer bearing member. By the potential difference between photoconductor drum 213 and the developer bearing member, the charging toner on the developer bearing member is caused to move and attach to a light exposure section on the surface of photoconductor drum 213.

Drum cleaning device 215 includes a drum cleaning blade that is brought into sliding contact with the surface of photoconductor drum 213, and removes residual toner that remains on the surface of photoconductor drum 213 after the primary transfer.

Intermediate transfer section 22 includes intermediate transfer belt 221, primary transfer roller 222, a plurality of support rollers 223, secondary transfer roller 224, belt cleaning device 225 and the like.

Intermediate transfer belt 221 is composed of an endless belt, and is stretched around the plurality of support rollers 223 in a loop form. At least one of the plurality of support rollers 223 is composed of a driving roller, and the others are each composed of a driven roller. When driving roller rotates, intermediate transfer belt 221 travels in arrow A direction at a constant speed.

Primary transfer rollers 222 are disposed on the inner periphery side of intermediate transfer belt 221 in such a manner as to face photoconductor drums 213 of respective color components. Primary transfer rollers 222 are brought into pressure contact with photoconductor drums 213 with intermediate transfer belt 221 therebetween, whereby a primary transfer nip (hereinafter referred to as "primary transfer section") for transferring a toner image from photoconductor drums 213 to intermediate transfer belt 221 is formed.

Secondary transfer roller 224 is disposed on the outer periphery side of intermediate transfer belt 221 in such a manner as to face one of support rollers 223. Support roller 223 that is so disposed as to face intermediate transfer belt 221 is called "backup roller."

Secondary transfer roller 224 is brought into pressure contact with the backup roller with intermediate transfer belt 221 therebetween, whereby a secondary transfer nip (hereinafter referred to as "secondary transfer section") for transferring a toner image from intermediate transfer belt 221 to a sheet is formed.

In the primary transfer section, the toner images on photoconductor drums 213 are sequentially primary-transferred to intermediate transfer belt 221. To be more specific, a primary transfer bias is applied to primary transfer rollers 222, and electric charge of the polarity opposite to the polarity of the toner is applied to the rear side (the side that makes contact with primary transfer rollers 222) of intermediate transfer belt 221, whereby the toner image is electrostatically transferred to intermediate transfer belt 221.

Thereafter, when the sheet passes through the secondary transfer section, the toner image on intermediate transfer belt 221 is secondary-transferred to the sheet. To be more specific, a secondary transfer bias is applied to secondary transfer roller 224, and an electric charge opposite to that of the toner is applied to the rear side (the side that makes contact with secondary transfer roller 224) of the sheet, whereby the toner image is electrostatically transferred to the sheet. The sheet on which the toner image has been transferred is conveyed toward fixing section 23.

Belt cleaning device 225 includes a belt cleaning blade configured to make sliding contact with the surface of intermediate transfer belt 221, and the like, and removes transfer residual toner remaining on the surface of intermediate transfer belt 221 after the secondary transfer.

Alternatively, in intermediate transfer section 22, it is also possible to adopt a configuration (so-called belt-type secondary transfer unit) in which a secondary transfer belt is installed in a stretched state in a loop form around a plurality of support rollers including a secondary transfer roller in place of secondary transfer roller 224.

Fixing section 23 includes upper fixing section 231 having a fixing side member disposed on a fixing surface (the surface on which a toner image is formed) side of a sheet, lower fixing section 232 having a back side supporting member disposed on the rear surface (the surface opposite to the fixing surface) side of a sheet, heating source 233 configured to heat the fixing side member, a pressure contact separation section (not illustrated) configured to bring the back side supporting member into pressure contact with the fixing side member, and the like.

For example, when upper fixing section 231 is of a roller heating type, the fixing roller serves as the fixing side member, and when upper fixing section 231 is of a belt heating type, the fixing belt serves as the fixing side member. In addition, for example, when lower fixing section 232 is of a roller pressing type, the pressure roller serves as the back side supporting member, and when lower fixing section 232 is of a belt pressing type, the pressing belt serves as the back side supporting member. FIG. 3 illustrates a configuration in which upper fixing section 231 is of a roller heating type, and lower fixing section 232 is of a roller pressing type.

Upper fixing section 231 includes upper fixing section-driving section (not illustrated) for rotating the fixing side member. When control section 17 controls the operation of the upper fixing section-driving section, the fixing side member rotates (travels) at a predetermined speed. Lower fixing section 232 includes lower fixing section-driving section (not illustrated) for rotating the back side supporting member. When control section 17 controls the operation of the lower fixing section-driving section, the back side supporting member rotates (travels) at a predetermined speed. It is to be noted that, in the case where the fixing side member follows the rotation of the back side supporting member, the upper fixing section-driving section is not required.

Heating source 233 is disposed inside or near the fixing side member. When control section 17 controls the output of heating source 233, the fixing side member is heated, and maintained at a predetermined temperature (for example, a fixable temperature, or a fixation idling temperature). On the basis of the detection result of a fixing temperature detection section (not illustrated) disposed at a position near the fixing side member, control section 17 controls the output of heating source 233.

A pressure contact separation section (not illustrated) presses the back side supporting member against the fixing side member. The pressure contact separation section makes contact with both ends of a shaft that supports the back side supporting member to separately press each end. With this structure, the balance of the nip pressure in the direction along the shaft in the fixing nip can be adjusted. When control section 17 controls the operation of the pressure contact separation section (not illustrated) such that the back side supporting member is brought into pressure contact with the fixing side member, a fixing nip for conveying a sheet in a tightly sandwiching manner is formed.

Heat and pressure are applied to a sheet on which a toner image has been secondary-transferred and which has been conveyed along a sheet feeding path at the time when the sheet passes through fixing section 23. Thus, the toner image is fixed to the sheet.

It is to be noted that fixing section 23 may include an air blowing section configured to apply air to the fixing side member or the back side supporting member in order to cool down the fixing side member or the back side supporting member, and in order to separate a sheet from the fixing side member or the back side supporting member.

Sheet feeding section 14 includes sheet feed tray section 141 and manual sheet feeding section 142. Flat sheets (standard type sheets and special type sheets) discriminated on the basis of their weight, size and the like are stored in sheet feed tray section 141 in advance on a predetermined type basis. Manual sheet feeding section 142 may be connected with an external sheet feeding apparatus (not illustrated) having a large capacity. Sheet feeding section 14 feeds a sheet fed from sheet tray section 141 or manual sheet feeding section 142 to sheet conveyance section 16.

Sheet ejection section 15 includes sheet ejection roller section 151 and the like, and ejects a sheet output by sheet conveyance section 16 out of the apparatus.

Sheet conveyance section 16 includes main conveyance section 161, switch-back conveyance section 162, rear surface printing conveyance section 163, sheet feeding path-switching section 164 and the like. For example, a part of sheet conveyance section 16 is incorporated in a unit together with fixing section 23, and is detachably mounted to image forming apparatus 1 (sheet conveyance unit ADU).

Main conveyance section 161 includes a plurality of conveyance roller sections including a loop roller section and a registration roller section which serve as sheet-conveyance elements for conveying sheets in a sandwiching manner. Main conveyance section 161 conveys a sheet fed from sheet-feed tray section 141 or manual sheet feeding section 142 to convey the sheet through image forming section 20 (secondary transfer section, fixing section 23), and conveys the sheet output from image forming section 20

(fixing section 23) toward sheet ejection section 15 or switch-back conveyance section 162.

Switch-back conveyance section 162 temporarily stops a sheet output from fixing section 23, reverses the sheet in the conveyance direction, and conveys the sheet to sheet ejection section 15 or rear surface printing conveyance section 163.

Rear surface printing conveyance section 163 conveys in a circulating manner a sheet switchbacked at switch-back conveyance section 162 to main conveyance section 161. A sheet passes through main conveyance section 161 in a state where the rear surface of the sheet is the image forming surface.

Feeding-path-switching section 164 switches the sheet feeding paths according to whether a sheet output from fixing section 23 is ejected as it is, or is inverted before being ejected, or, is conveyed to rear surface printing conveyance section 163. To be more specific, control section 17 controls the operation of the conveyance path switching section 164 on the basis of the processing detail of the image formation process (one-side/duplex printing, face-up/face-down sheet ejection, and the like).

A sheet fed from sheet feeding section 14 is conveyed to image forming section 20 by main conveyance section 161. Thereafter, a toner image on intermediate transfer belt 221 is secondary-transferred to a first surface (front surface) of the sheet at one time at the time when the sheet passes through the secondary transfer section, and then a fixing process is performed in fixing section 23. A sheet on which an image is formed is ejected out of the apparatus by sheet ejection section 15. When images are formed on both sides of a sheet, the sheet on which an image has been formed on its first surface is output to switch-back conveyance section 162, and then inverted by being returned to main conveyance section 161 through rear surface printing conveyance section 163 before an image is formed on its second surface (rear surface).

Figure 5A:
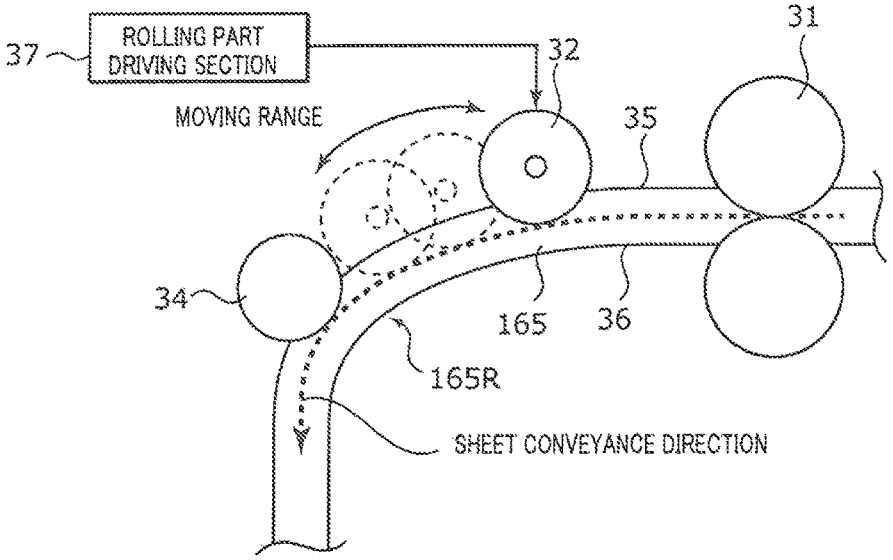
FIG. 5A is a side view illustrating an exemplary curving part of a sheet feeding path.
Figure 5B:
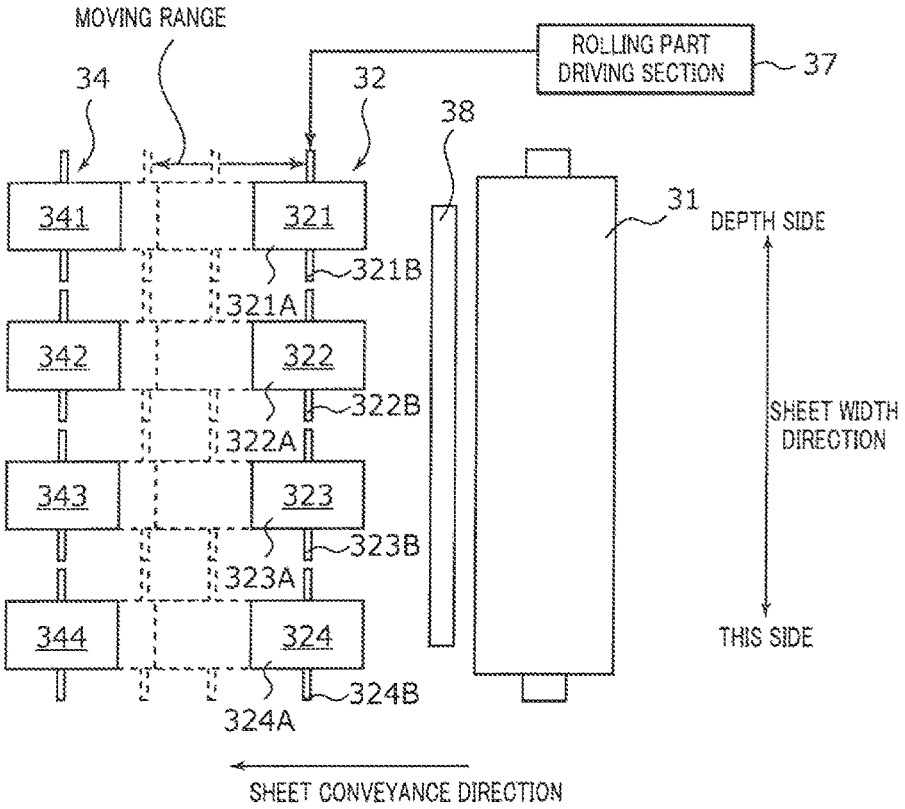
FIG. 5B is a plan view illustrating an exemplary curving part of the sheet feeding path.

In addition, as illustrated with a broken line in FIG. 3, sheet conveyance section 16 of image forming apparatus 1 has a sheet feeding path having a curved shape. With this configuration, the size of the apparatus can be reduced and double-sided printing can be achieved. FIGS. 5A and 5B illustrate an exemplary curving part of the sheet feeding path. Sheet feeding path 165 illustrated in FIGS. 5A and 5B is a sheet feeding path at a position on the downstream side in the sheet conveyance direction of fixing section 23 after fixation for example.

As illustrated in FIGS. 5A and 5B, sheet feeding path 165 of image forming apparatus 1 is formed by conveyance guides 35 and 36 that respectively face the front and rear surfaces of a sheet. The curving part of sheet feeding path 165 is referred to as "curving part 165R." Conveyance guide 35 is disposed on the side which can make contact with the image forming surface of a sheet, and in this case, conveyance guide 35 is disposed on the upper side.

At curving part 165R, conveyance rolling parts 32 and 34 having a small frictional coefficient are disposed in such a manner as to protrude from conveyance guide 35 into sheet feeding path 165. Conveyance rolling parts 32 and 34 are conveyance mechanisms having rotating members (rolling member main bodies) that make contact with a conveyed sheet and rotate along the sheet, and examples of the conveyance rolling part include a conveyance rolling part having one wide rolling member extending in the sheet width direction, and a conveyance rolling part having a plurality of narrow rolling members juxtaposed along the sheet width direction. In this case, as illustrated in FIG. 5B, conveyance rolling parts 32 and 34 include rolling members 321 to 324 and rolling members 341 to 344, respectively, which are juxtaposed along the sheet width direction. In the following, conveyance rolling part 32 disposed on the upstream side in the sheet conveyance direction is referred to as "upstream conveyance rolling part 32," and conveyance rolling part 34 disposed on the downstream side in the sheet conveyance direction is referred to as "downstream conveyance rolling part 34."

Upstream conveyance rolling part 32 is disposed at a position, as its initial position, on the most upstream side in the sheet conveyance direction in curving part 165R of sheet feeding path 165, that is, at a position where a sheet output from conveyance roller section 31 enters curving part 165R. Upstream conveyance rolling part 32 is supported with a bearing (not illustrated) attached in such a manner as to be movable along a guide groove of a frame (not illustrated) of a conveyance rolling part unit, for example. The protruding amount of upstream conveyance rolling part 32 from conveyance guide 35 at the initial position is set such that an entering angle of an end of a sheet output from conveyance roller section 31 is at 45 degrees or smaller.

Rolling members 321 to 324 are separately provided, and bearings corresponding to rolling members 321 to 324 are respectively provided. It is to be noted that, when a rolling shaft is commonly used by rolling members 321 to 324, bearings are provided at both ends of upstream conveyance rolling part 32 (on the outside of rolling members 321 and 324 in the sheet width direction).

Figure 9A:
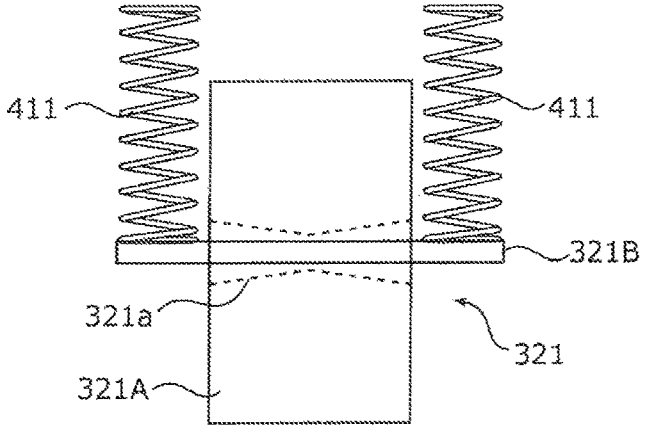
FIG. 9A illustrates an exemplary insertion hole formed in the movable rolling member.
Figure 9B:
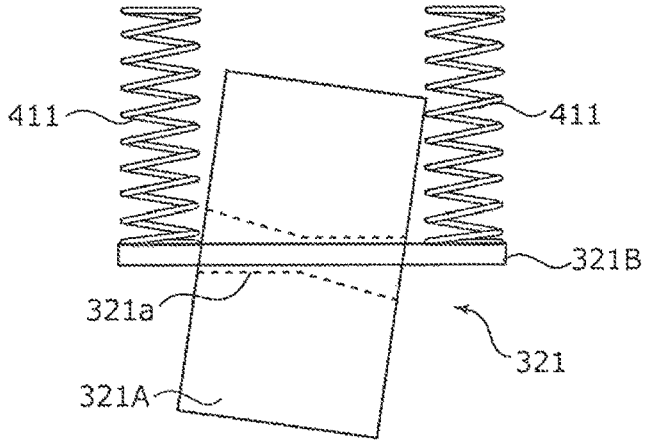
FIG. 9B illustrates an exemplary insertion hole formed in the movable rolling member.
Figure 9C:
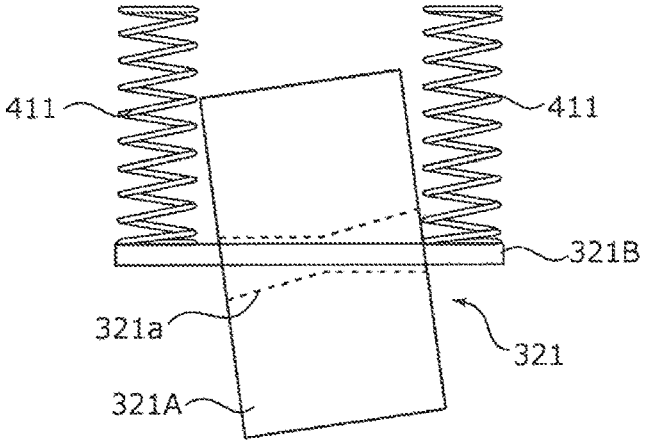
FIG. 9C illustrates an exemplary insertion hole formed in the movable rolling member.

Rolling member 321 includes rolling member main body 321A that makes contact with a sheet and rolling member shaft 321B that is inserted to insertion hole 321*a* of rolling member main body 321A (see FIGS. 9A to 9C). Rolling member shaft 321B is loosely fixed in bearing shaft hole 421 (see FIG. 7) that is provided in each of rolling members 321 to 324. Rolling member main body 321A rotates about rolling member shaft 321B along with conveyance of a sheet. It is to be noted that rolling member main body 321A and rolling member shaft 321B may integrally rotate. The same applies to rolling members 322 to 324.

Downstream conveyance rolling part 34 is disposed at a position on the most downstream side in the sheet conveyance direction in curving part 165R of sheet feeding path 165, that is, at a position where the image forming surface of a sheet that has passed over downstream conveyance rolling part 34 does not make contact with conveyance guide 35. Downstream conveyance rolling part 34 is supported with a bearing fixed to a frame (not illustrated) of the conveyance rolling part unit, for example. The protruding amount of downstream conveyance rolling part 34 from conveyance guide 35 is set such that an entering angle of an end of a sheet output from upstream conveyance rolling part 32 is at 45 degrees or smaller. Rolling members 341 to 344 of downstream conveyance rolling part 34 have the same configuration as those of rolling members 321 to 324 of upstream conveyance rolling part 32.

Upstream conveyance rolling part 32 and downstream conveyance rolling part 34 are separated from each other in the sheet conveyance direction. To be more specific, upstream conveyance rolling part 32 and downstream conveyance rolling part 34 are disposed such that, in the case where upstream conveyance rolling part 32 does not move from the initial position, a sheet that has passed over upstream conveyance rolling part 32 makes contact with conveyance guide 35 before it reaches downstream conveyance rolling part 34.

The bearing of upstream conveyance rolling part 32 is connected with rolling part driving section 37 having a power transmission mechanism and a drive motor (for example, a stepping motor). When control section 17 controls the operation of rolling part driving section 37 (drive motor), upstream conveyance rolling part 32 moves along sheet feeding path 165. To be more specific, upstream conveyance rolling part 32 starts to move after a sheet has reached upstream conveyance rolling part 32, and, without making contact with conveyance guide 35, moves to a position where the sheet can be passed on to downstream conveyance rolling part 34.

In this case, the protruding amount of upstream conveyance rolling part 32 from conveyance guide 35 may be changed in accordance with the curvature of curving part 165R of sheet feeding path 165. In this manner, a sheet can be smoothly conveyed to the downstream side in the sheet conveyance direction. The protruding amount of upstream conveyance rolling part 32 from conveyance guide 35 can be controlled by the shape of a guide groove of a frame (not illustrated) for example.

Sheet detection section 38 that detects presence/absence of a sheet is disposed between conveyance roller section 31 and upstream conveyance rolling part 32. Sheet detection section 38 is composed of a reflection type or transmission type light sensor, for example. On the basis of a detection result of sheet detection section 38, control section 17 controls the operation of rolling part driving section 37. By providing sheet detection section 38, the timing when a sheet output from conveyance roller section 31 reaches upstream conveyance rolling part 32 and the like can be correctly determined, and consequently malfunction of rolling part driving section 37 can be prevented.

Figure 6:
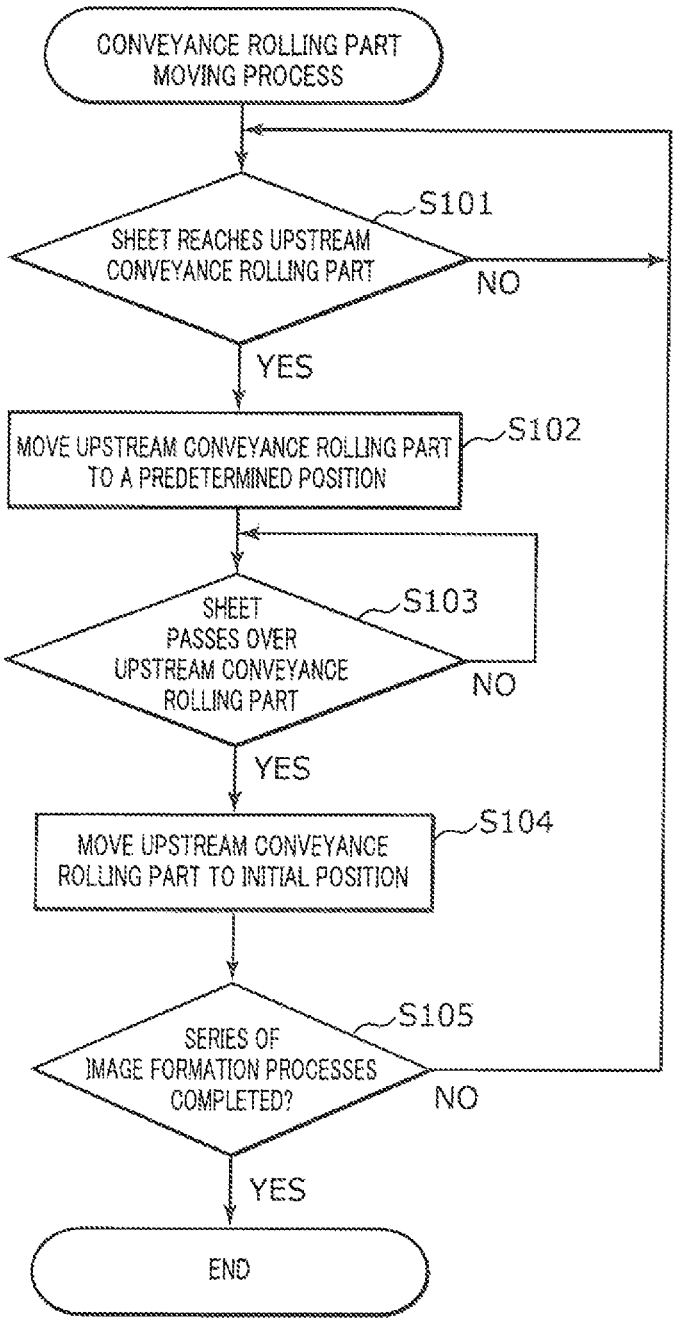
FIG. 6 is a flowchart of an exemplary conveyance rolling part moving process.

To be more specific, control section 17 controls the operation of rolling part driving section 37 in accordance with the flowchart of FIG. 6. FIG. 6 is a flowchart of an exemplary conveyance rolling part moving process. This process is achieved when CPU 171 executes a predetermined program stored in ROM 172 upon the start of an image formation process on a sheet in image forming apparatus 1 for example.

At step S101, control section 17 determines whether a sheet has reached upstream conveyance rolling part 32. Whether the sheet has reached upstream conveyance rolling part 32 is determined on the basis of a detection result of sheet detection section 38. When the sheet has reached upstream conveyance rolling part 32 ("YES" at step S101), the process is advanced to step S102.

At step S102, control section 17 controls rolling part driving section 37 to start the operation, and moves upstream conveyance rolling part 32 to a predetermined position along sheet feeding path 165. The moving speed of upstream conveyance rolling part 32 at this time is set in accordance with the sheet conveyance speed. Since upstream conveyance rolling part 32 moves along with the conveyance of the sheet, the sheet is passed on to downstream conveyance rolling part 34 without bringing the image forming surface into contact with conveyance guide 35. Thus, it is possible to reduce damage that is left on a sheet when the image forming surface makes contact with conveyance guide 35.

At step S103, control section 17 determines whether the sheet has completely passed over upstream conveyance rolling part 32. Whether the sheet has completely passed over upstream conveyance rolling part 32 is determined on the basis of a detection result of sheet detection section 38. When the sheet has passed over upstream conveyance rolling part 32 ("YES" at step S103), the process is advanced to step S104.

At step S104, control section 17 controls rolling part driving section 37 to start the operation, and moves upstream conveyance rolling part 32 to the initial position along sheet feeding path 165. This operation is performed before the next sheet reaches the initial position of upstream conveyance rolling part 32. In this manner, it is possible to prevent the image formation process from being interrupted along with the movement of upstream conveyance rolling part 32.

It is to be noted that, when the sheet has already been passed on to downstream conveyance rolling part 34, the resetting operation to the initial position of upstream conveyance rolling part 32 may be started before the sheet completely passes over upstream conveyance rolling part 32.

At step S105, control section 17 determines whether the series of image formation processes have been completed. The series of image formation processes is processes for forming an image based on a signal requesting image formation (for example, printing job). When the series of image formation processes has been completed ("YES" at step S105), the conveyance rolling part moving process is terminated. When the series of image formation processes has not been completed ("NO" at step S105), the process is advanced to step S101. That is, when second, third, . . . Nth sheets are conveyed, the moving process of upper side conveyance rolling part 32 is performed in the same manner.

As described, image forming apparatus 1 according to the embodiment includes: image forming section 20 configured to form an image on a sheet; conveyance guides 35 and 36 disposed on an image forming surface side and a rear surface side of the sheet at a position on a downstream side of image forming section 20, and configured to form sheet feeding path 165 for conveying the sheet; conveyance rolling part 32 (conveyance rolling part) disposed to protrude from conveyance guide 35 into sheet feeding path 165 at curving part 165R of sheet feeding path 165; and rolling member moving section (rolling part driving section 37 and control section 17) configured to move conveyance rolling part 32 along sheet feeding path 165 until a state where an image forming surface of a sheet being conveyed does not make contact with conveyance guide 35 is ensured.

To be more specific, image forming apparatus 1 includes downstream conveyance rolling part 34 disposed on the downstream side of upstream conveyance rolling part 32 (conveyance rolling part) in the sheet conveyance direction, and the rolling member moving section (rolling part driving section 37 and control section 17) moves upstream conveyance rolling part 32 until the sheet being conveyed is passed on to downstream conveyance rolling part 34 without being brought into contact with conveyance guide 35.

In image forming apparatus 1, along with the conveyance of a sheet, upstream conveyance rolling part 32 moves along sheet feeding path 165 having a curved shape, and thus the sheet can be readily conveyed without causing failure (damage on the image forming surface, damage at an end portion in the sheet width direction and the like). In addition, since the rolling members of the conveyance rolling parts adjacent to each other are not required to be disposed in a staggered manner in the sheet width direction, the degree of freedom in design is remarkably improved, and variously-sized sheets can be handled.

Furthermore, in image forming apparatus 1, a sheet is conveyed without being brought into contact with conveyance guide 35. Thus, the image forming surface can be prevented from being damaged, and high quality image products can be produced.

Preferably, upstream conveyance rolling part 32 is configured to follow the conveyance condition of a sheet (for example, the degree of curl). To be more specific, rolling members 321 to 324 include a movable rolling member that is displaced in accordance with the conveyance condition of a sheet. The term "displacement" includes movement in the sheet thickness direction and skew in the sheet width direction. In this case all of rolling members 321 to 324 function as the movable rolling member. Alternatively, some of rolling members 321 to 324, for example, only rolling members 322 and 323 disposed at a center of upstream conveyance rolling part 32, or only rolling members 321 and 324 disposed at both ends thereof may function as the movable rolling member.

Figure 7:
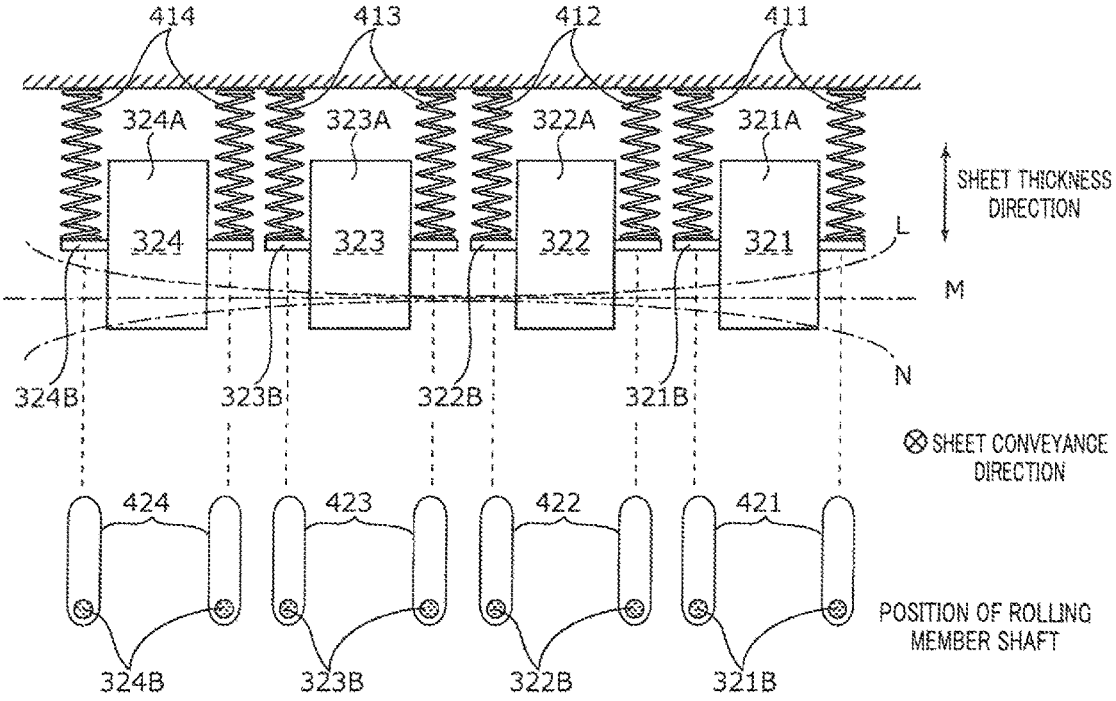
FIG. 7 illustrates exemplary movable rolling members in an upstream conveyance rolling part.

FIG. 7 illustrates exemplary movable rolling members (rolling members 321 to 324) in upstream conveyance rolling part 32. In FIG. 7, dashed line L illustrates a conveyance position of a sheet having a curl bulging downward, dashed line M a conveyance position of a flat sheet, and dashed line N a conveyance position of a sheet having a curl bulging upward.

As illustrated in FIG. 7, rolling member shafts 321B to 324B are loosely fixed in respective bearing shaft holes 421 to 424 of rolling members 321 to 324, whereby rolling members 321 to 324 are supported. Shaft holes 421 to 424 each have an ellipsoidal shape elongated in the sheet thickness direction. In a non-conveyance state where no sheet is being conveyed, rolling member shafts 321B to 324B of rolling members 321 to 324 are located at a lowermost position of respective shaft holes 421 to 424. That is, rolling members 321 to 324 can be tilted and moved along shaft holes 421 to 424.

In addition, rolling members 321 to 324 are provided to a fixing body (for example, a frame (not illustrated) of a conveyance rolling unit) in a suspended manner through biasing members 411 to 414 (for example, a tensile coil spring). In a non-conveyance state, the gravity acting on rolling members 321 to 324 and the restoration force of biasing members 411 to 414 are balanced, whereas in a conveyance state, rolling members 321 to 324 are pushed upward by the contacting pressure of the sheet.

Figure 8A:
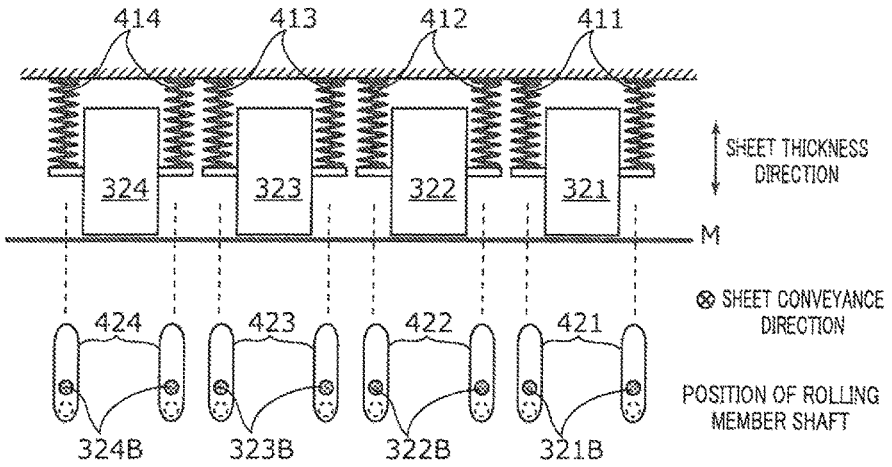
FIG. 8A illustrates a state of the upstream conveyance rolling part at the time of sheet conveyance.
Figure 8B:
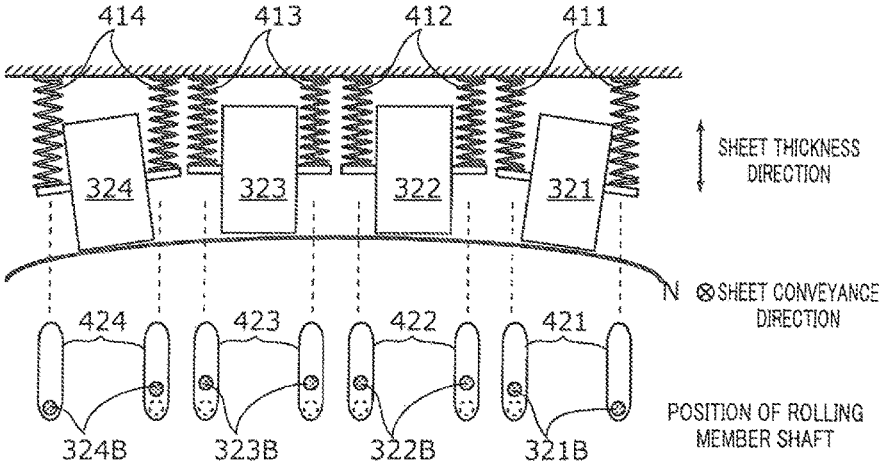
FIG. 8B illustrates a state of the upstream conveyance rolling part at the time of sheet conveyance.
Figure 8C:
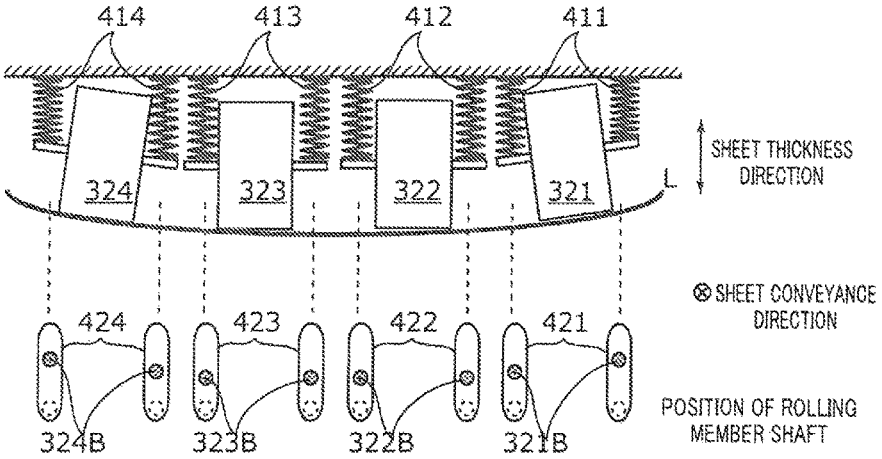
FIG. 8C illustrates a state of the upstream conveyance rolling part at the time of sheet conveyance.

FIGS. 8A to 8C illustrate states of upstream conveyance rolling part 32 at the time of sheet conveyance. FIG. 8A illustrates a state where a flat sheet is being conveyed, FIG. 8B a state where a sheet having a curl bulging upward is being conveyed, and FIG. 8C a state where a sheet having a curl bulging downward is being conveyed.

When a flat sheet is conveyed over upstream conveyance rolling part 32, the force of the sheet exerted on rolling members 321 to 324 is equal to each other. Accordingly, as illustrated in FIG. 8A, rolling members 321 to 324 are evenly pushed up.

When a sheet having a curl bulging upward is conveyed over upstream conveyance rolling part 32, the force of the sheet exerted on a center of rolling members 321 to 324 is greater than the force of the sheet exerted on both end portions of rolling members 321 to 324. Accordingly, as illustrated in FIG. 8B, rolling members 322 and 323 located at a center are pushed up higher than rolling members 321 and 324 located at both end portions. In addition, along the shape of the curl of the sheet, rolling member 321 is tilted clockwise, and rolling member 324 is tilted counterclockwise.

When a sheet having a curl bulging downward is conveyed over upstream conveyance rolling part 32, the force of the sheet exerted on both end portions of rolling members 321 to 324 is greater than the force of the sheet exerted on a center of rolling members 321 to 324. Accordingly, as illustrated in FIG. 8C, rolling members 321 and 324 located at both end portions are pushed up higher than rolling members 322 and 323 located at a center. In addition, along the shape of the curl of the sheet, rolling member 321 is tilted counterclockwise, and rolling member 324 is tilted clockwise.

FIGS. 9A to 9C illustrate an exemplary insertion hole 321*a* formed in rolling member 321. FIG. 9A illustrates a state where a flat sheet is being conveyed, FIG. 9B a state where a sheet having a curl bulging upward is being conveyed, and FIG. 9C a state where a sheet having a curl bulging downward is being conveyed.

Preferably, in rolling member 321 configured to be tilted in accordance with the shape of the curl of the sheet, insertion hole 321*a* formed in rolling member main body 321A has a tapered shape whose diameter decreases toward the center from the both ends in the longitudinal direction as illustrated in FIGS. 9A to 9C. The same applies to rolling member 341 that is symmetrically disposed with rolling member 321 about the sheet width direction. Rolling member 341 is brought into a state illustrated in FIG. 9B when a sheet having a curl bulging downward is conveyed, and is brought into a state illustrated in FIG. 9C when a sheet having a curl bulging upward is conveyed.

When the degree of the curl of the sheet is small, rolling member main bodies 321A and 324A are tilted with respect to rolling member shafts 321B and 324B, and when the degree of the curl is great, rolling member shafts 321B and 324B are further tilted. Thus, rolling members 321 and 324 can readily follow the sheets of various curl shapes.

Figure 10A:
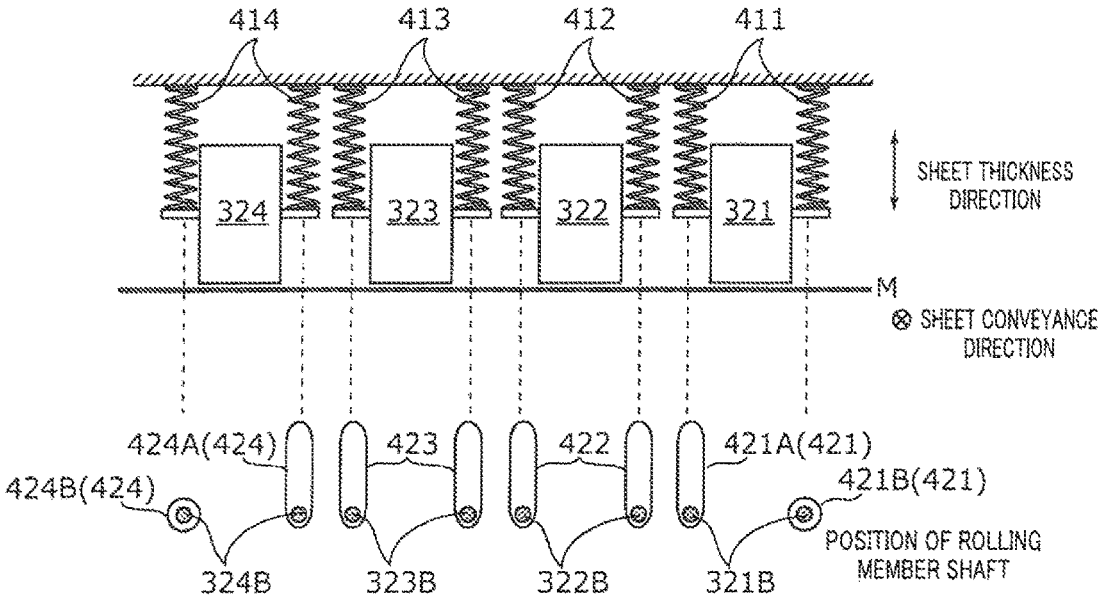
FIG. 10A illustrates other exemplary movable rolling members in the upstream conveyance rolling part.
Figure 10B:
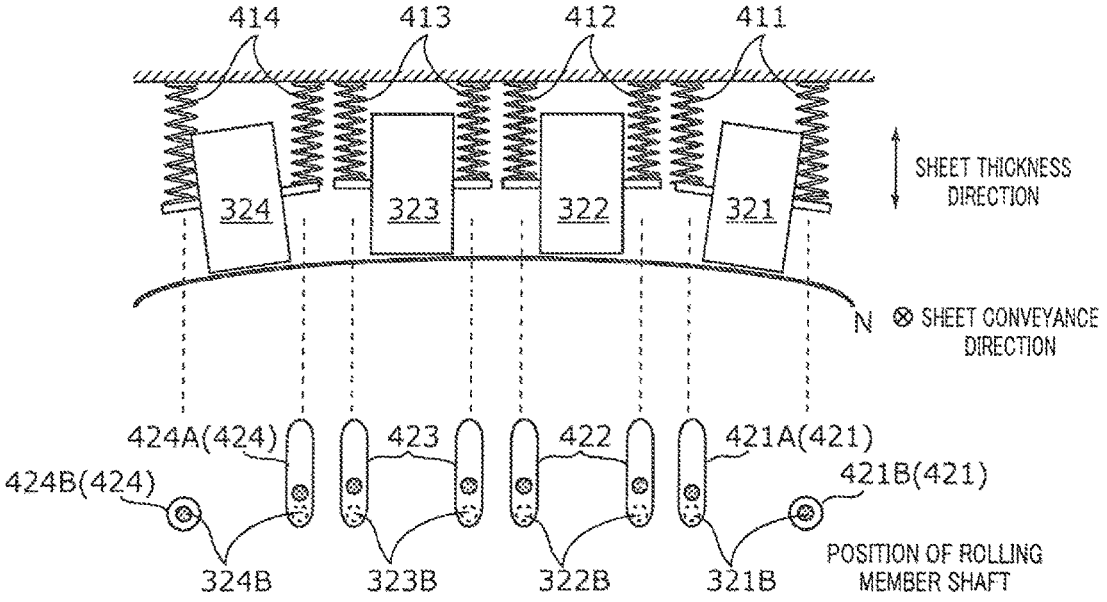
FIG. 10B illustrates other exemplary movable rolling members in the upstream conveyance rolling part.

FIGS. 10A and 10B illustrate another example of the movable rolling members (rolling members 321 to 324) in upstream conveyance rolling part 32. FIG. 10A illustrates a state where a flat sheet is being conveyed, and FIG. 10B a state where a sheet having a curl bulging upward is being conveyed. It is to be noted that the configuration illustrated in FIGS. 10A and 10B cannot handle a curl bulging downward.

As illustrated in FIGS. 10A and 10B, bearing shaft holes 421 and 424 corresponding to rolling members 321 and 341 may be formed such that the holes on the inside in the sheet width direction (shaft holes 421A and 424A) each have an ellipsoidal shape and the holes on the outside in the sheet width direction (shaft holes 421B and 424B) each have a circular shape. The outer diameter of each of shaft holes 421B and 424B is greater than that of each of rolling member shafts 321B and 324B such that rolling members 321 and 341 can be tilted.

When a flat sheet is conveyed over upstream conveyance rolling part 32, the force of the sheet exerted on rolling members 321 to 324 is equal to each other, but rolling member shafts 321B and 324B of rolling members 321 and 324 are constrained by shaft holes 421B and 424B. Thus, as illustrated in FIG. 9A, rolling members 321 to 324 are not displaced.

When a sheet having a curl bulging upward is conveyed over upstream conveyance rolling part 32, the force of the sheet exerted on both end portions of rolling members 321 to 324 is greater than the force of the sheet exerted on a center portion of rolling members 321 to 324. Accordingly, as illustrated in FIG. 9B, rolling members 322 and 323 at a center are pushed up, and rolling members 321 and 324 at both end portions are tilted along the curl shape of the sheet.

In the case where upstream conveyance rolling part 32 is configured to follow the conveyance condition of the sheet (for example, the degree of curl) as illustrated in FIGS. 7 to 10B, the sheet can be advanced at an appropriate angle with respect to upstream conveyance rolling part 32, and thus corner folding of the sheet can be prevented. In addition, since upstream conveyance rolling part 32 and the sheet evenly make contact with each other in the sheet width direction, mark of the conveyance rolling part, which is left when upstream conveyance rolling part 32 and the sheet partially make contact with each other, can be prevented from being left. The same applies to downstream conveyance rolling part 34.

While the invention made by the present inventor has been specifically described based on the preferred embodiments, it is not intended to limit the present invention to the above-mentioned preferred embodiments but the present invention may be further modified within the scope and spirit of the invention defined by the appended claims.

For example, while upstream conveyance rolling part 32 and downstream conveyance rolling part 34 are disposed at curving part 165R in the embodiment, it is possible to adopt a configuration in which only upstream conveyance rolling part 32 is disposed and moved until a state where the image forming surface of the sheet being conveyed does not make contact with conveyance guide 35 is ensured. In addition, as long as the downsizing of the apparatus can be achieved, other conveyance rolling parts may be disposed at sheet feeding path 165.

In addition, for example, in the case where upstream conveyance rolling part 32 is configured to follow the conveyance condition of the sheet (for example, the degree of curl), it is possible to provide a sheet shape detection section that detects the shape of the sheet being conveyed and a rolling member displacement section that displaces the movable rolling member based on the detection result of sheet shape detection section. In this case, sheet detection section 38 disposed on the upstream side of upstream conveyance rolling part 32 in the sheet conveyance direction may be utilized as the sheet shape detection section. In addition, the bearing of upstream conveyance rolling part 32 is connected with a rolling part displacement driving section (not illustrated) having a power transmission mechanism and a drive motor (for example, a stepping motor). Control section 17 controls the operation of the rolling part displacement driving section (not illustrated) on the basis of the detection result of sheet detection section 38, and upstream conveyance rolling part 32 is displaced to follow the shape of the sheet. That is, the rolling member displacement section is composed of control section 17 and the rolling part displacement driving section (not illustrated).

Figure 11A:
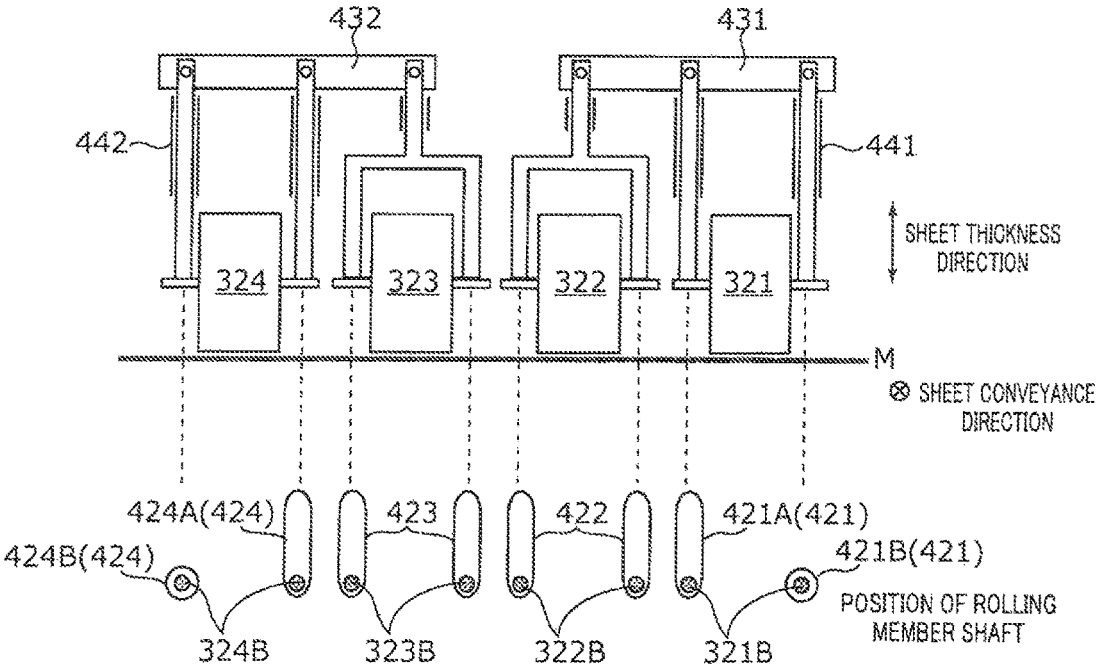
FIG. 11A illustrates other exemplary movable rolling members in the upstream conveyance rolling part.
Figure 11B:
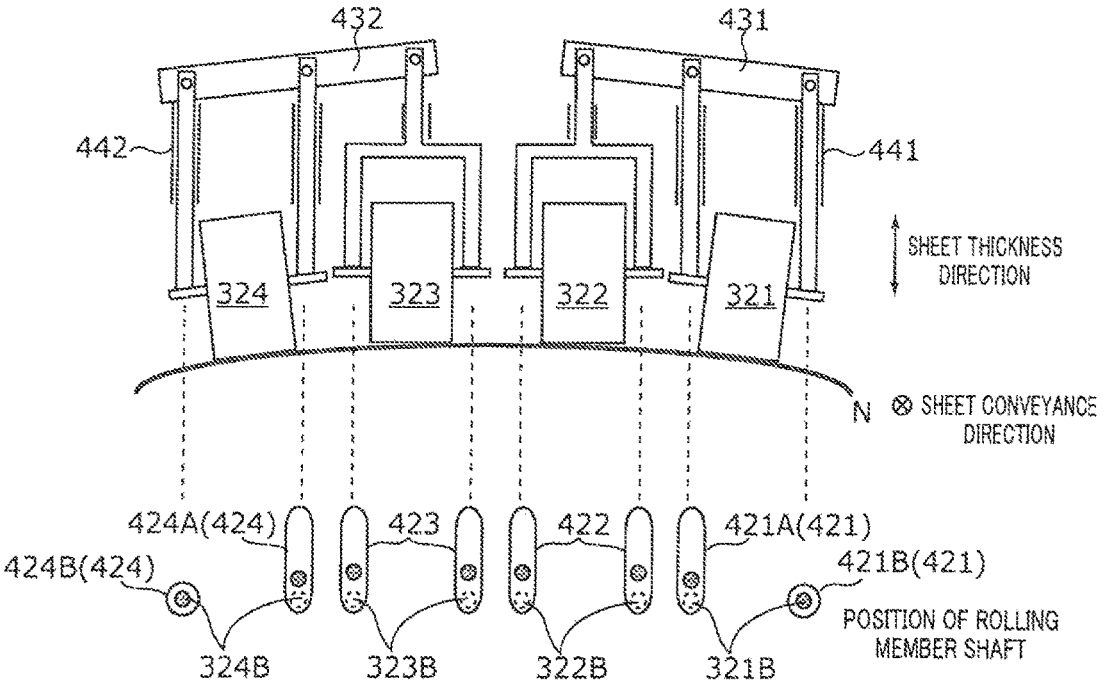
FIG. 11B illustrates other exemplary movable rolling members in the upstream conveyance rolling part.

In addition, it is possible to adopt a configuration in which movable rolling members 321 and 322 of upstream conveyance rolling part 32 are coupled by linking member 431, and movable rolling members 323 and 324 of upstream conveyance rolling part 32 are coupled by linking member 432 as illustrated in FIGS. 11A and 11B. Linking members 431 and 432 are provided to a fixing body (for example, a frame of a conveyance rolling part unit (not illustrated)) through a biasing member (not illustrated) in a suspended manner. In this case, preferably, restriction members 441 and 442 that restrict the moving direction of linking members 431 and 432 are provided. As illustrated in FIG. 11B, when a sheet having a curl bulging upward is conveyed over upstream conveyance rolling part 32, rolling members 322 and 323 at a center are pushed up, and the center side portions of rolling members 321 and 324 are pulled up by a linking mechanism, whereby upstream conveyance rolling part 32 surely follows the conveyance condition of the sheet.

The embodiment disclosed herein is merely an exemplification and should not be considered as limitative. The scope of the present invention is specified by the following claims, not by the above-mentioned description. It should be understood that various modifications, combinations, subcombinations and alterations may occur depending on design requirements and other factors in so far as they are within the scope of the appended claims or the equivalents thereof.

What is claimed is:

1. An image forming apparatus comprising:

an image forming section configured to form an image on a sheet;

conveyance guides that oppose each other on an image forming surface side and a rear surface side, respectively, of the sheet at a position on a downstream side of the image forming section in a sheet conveyance direction, and configured to form a curving sheet feeding path for conveying the sheet;

a conveyance rolling part comprising a rolling member main body and a rolling member shaft, the rolling member main body disposed to protrude from the radially outermost one of the conveyance guides into the sheet feeding path at the curving part of the sheet feeding path where the conveyance guides oppose each other, the rolling member shaft extending through an insertion hole of the rolling member main body such that the rolling member main body is rotatable about the rolling member shaft; and a rolling member moving section configured to move the conveyance rolling part downstream along the curved part of the sheet feeding path when the sheet reaches the conveyance rolling part by moving both the rolling member main body and the rolling member shaft downstream along the curved part of the sheet feeding path to ensure that the surface of a sheet being conveyed does not make contact with the radially outermost one of the conveyance guides.

2. The image forming apparatus according to claim 1 further comprising a downstream conveyance rolling part disposed on a downstream side of the conveyance rolling part in the sheet conveyance direction, wherein the rolling member moving section moves the conveyance rolling part to a position where the sheet being conveyed is passed on to the downstream conveyance rolling part without being brought into contact with the conveyance guides.

3. The image forming apparatus according to claim 1, wherein the rolling member moving section resets the conveyance rolling part to an initial position before a next sheet is conveyed thereto.

4. The image forming apparatus according to claim 1 further comprising a sheet detection section disposed on an upstream side of the conveyance rolling part in the sheet conveyance direction, and configured to detect the sheet being conveyed, wherein the rolling member moving section moves the conveyance rolling part based on a detection result of the sheet detection section.

5. The image forming apparatus according to claim 1, wherein a protruding amount of the conveyance rolling part from the conveyance guides is set in accordance with a curvature of the sheet feeding path.

6. The image forming apparatus according to claim 1, wherein:

the conveyance rolling part includes a plurality of rolling members juxtaposed along a sheet width direction; and the rolling members include a movable rolling member configured to be displaced in accordance with a conveyance condition of the sheet.

7. The image forming apparatus according to claim 6, wherein:

the movable rolling member is suspended with a biasing member.

8. The image forming apparatus according to claim 7, wherein the insertion hole has a tapered shape whose diameter decreases toward a center from both ends in a longitudinal direction.

9. The image forming apparatus according to claim 6, wherein a plurality of the movable rolling members are coupled by a linking mechanism.

10. The image forming apparatus according to claim 6, further comprising:

a sheet shape detection section configured to detect a shape of the sheet being conveyed; and a rolling member displacement section configured to displace the movable rolling member based on a detection result of the sheet shape detection section.

11. The image forming apparatus according to claim 1, further comprising a sheet detection section configured to detect the sheet being conveyed, wherein the rolling member moving section moves the conveyance rolling part based on a detection result of the sheet detection section.

* * * * *